United States Patent [19]

Greenwald

[11] 4,287,396

[45] Sep. 1, 1981

[54] CONTROL DEVICE FOR A COIN OPERATED MECHANISM

[75] Inventor: Harry Greenwald, Whitestone, N.Y.

[73] Assignee: Greenwald Electro-Mechanical Consultants, Inc., Whitestone, N.Y.

[21] Appl. No.: 112,461

[22] Filed: Jan. 16, 1980

[51] Int. Cl.[3] ..... G07F 15/12

[52] U.S. Cl. ..... 200/35 R; 74/575; 194/1 M

[58] Field of Search ..... 200/35 R, 34 R, 37 A, 200/38 A, 38 F, 38 DA, 38 DB, 38 DC; 194/1 M, 1 L, 9 R, 61; 335/140; 318/470; 235/100; 74/575, 577 S, 142

[56] References Cited

U.S. PATENT DOCUMENTS

| | | | |
|---|---|---|---|
| 2,915,692 | 12/1959 | Greenwald | 200/35 R |
| 3,075,056 | 9/1961 | Hall | 74/142 |
| 3,168,947 | 8/1962 | Greenwald | 194/61 |
| 3,614,681 | 9/1971 | Greenwald | 335/140 |
| 3,683,711 | 8/1972 | Bowman et al. | 74/142 |
| 4,094,396 | 6/1978 | Greenwald | 194/1 M |

*Primary Examiner*—J. V. Truhe

*Assistant Examiner*—Donald L. Rebsch

*Attorney, Agent, or Firm*—McAulay, Fields, Fisher, Goldstein & Nissen

[57] ABSTRACT

A control device for a coin operated mechanism wherein the device includes a ratchet wheel formed having a plurality of teeth each having a front and a back face defining a tooth apex. The back face of each tooth and the front face of the next adjacent tooth define a well therebetween. The front face of each tooth is formed having a step which receives a ratchet follower to displace a normally open switch to its closed state at the end of each stepping operation of the ratchet wheel to operate the mechanism. A star wheel is operatively driven by a timing mechanism when the switch is in its closed state and is disposed to engage the ratchet wheel to cause rotation of the ratchet wheel conjointly upon rotation of the star wheel. The ratchet follower is displaced out of engagement with the ratchet tooth step and rides up the front face of the tooth over the apex and drops down the back face of the tooth, upon conjoint rotation of the star wheel and the ratchet wheel, whereby the ratchet follower is received within the next adjacent well thereby to open the switch.

6 Claims, 7 Drawing Figures

CONTROL DEVICE FOR A COIN OPERATED MECHANISM

BACKGROUND OF THE INVENTION

1. Field of the Invention

This invention relates, generally, to coin operated mechanisms and, more particularly, to a control arrangement for preventing rapid on-off cycling or flutter of the timer and mechanism being controlled, due to flutter or vibration in the leaf-spring control switch.

2. Description of the Prior Art

Coin operated mechanisms of the type commonly referred to as commercial applicances, such as clothes washers and dryers, are usually provided with rotary coin meters or coin slide assemblies which require the insertion of one or more coins to initiate the operating cycle of the mechanism. The length or duration of the operating cycle is controlled by an electrically operated timer which is part of the control device. Examples of such prior art control devices are disclosed in U.S. Pat. Nos. 2,915,692; 3,168,947; 3,172,520, 3,614,681, and 4,094,396.

In one form of such control device, a ratchet wheel and a star wheel are rotatably mounted on a common shaft. Each of said wheels carries an eccentrically mounted pin located at an equal radial distance from the axis of the shaft and has a series of equally spaced teeth with wells defined therebetween The pins project toward one another and are adapted to engage upon rotation of one wheel relative to the other. The ratchet wheel is driven or stepped by a pawl assembly which, in turn, is operatively associated with either a coin slide assembly or solenoid assembly. In either case, deposit of a proper coin in the device permits the coin slide or solenoid to operatively move the pawl assembly in a manner to stepwise rotate the ratchet wheel in one direction a distance of one tooth. Such rotation establishes an angular separation between the pins of the ratchet wheel and the star wheel. A spring biased arm having a ratchet follower portion is provided to operatively connect the ratchet wheel to a snap-action leaf spring switch. The operation is such that as the ratchet wheel rotates, the ratchet follower moves up a tooth front face to the tooth apex, and finally drops down the back tooth face into the next adjacent well. This carries the arm up and down which, in turn, normally effects movement of the switch to an open and closed state, respectively, stopping or initiating, respectively, the operating cycle of the mechanism. As the stepwise rotation of the ratchet wheel is so arranged as to always be completed with the ratchet follower disposed in a well, the switch is released to move to its closed state at the end of each stepping operation.

Movement of the switch to its closed state also serves to energize an electrically operated timer which, in turn, effects rotation of a pin wheel attached to the timing motor shaft. The coin operated mechanism load is simultaneously energized by the switch. Rotation of the pin wheel causes the pins thereof to engage with the teeth of the star wheel and intermittently rotate said star wheel in the same direction of rotation as the ratchet wheel. Rotation of the star wheel causes the pin therof to engage with the pin of the ratchet wheel. Continued rotation of the pin wheel effects conjoint rotation of the star wheel and the ratchet wheel in said one direction, due to the engagement of said pins. As the ratchet wheel rotates, the ratchet follower rides out of a valley and up the next adjacent ratchet tooth front face until the switch operating arm is displaced to a position to effect movement of the switch to its open state. This switches off the power supply to de-energize the timer and the load, and terminates the operating cycle of the mechanism.

In the device as described above, it is possible for the star wheel to counterrotate in a direction opposite to said one direction when the switch is in its open state and permit the ratchet sheel to similarly counterrotate in said opposite direction under the influence of the spring biased switch arm. Such counterrotation of the ratchet wheel permits the ratchet follower to drop back into a well between adjacent teeth thereby effecting movement of the switch to its closed state and activating the timer and mechanism. This, again, causes the pin wheel to rotate ever so slightly causing conjoint rotation of the star wheel and ratchet wheel until the ratchet follower is again displaced out of the well and up the front face of the next adjacent tooth to effect movement of the switch to its open state.

Restraining means, such as disclosed in U.S. Pat. Nos. 2,915,692 and 4,094,396, are intended to prevent or reduce the likelihood of such counterrotation of the ratchet wheel after the mechanism has completed an operating cycle. However, it has been found that these star wheel/ratchet wheel type of mechanisms still can rapidly cycle on and off, possibly burning-out the swithces and motors controlled by the device. Apparently, this is caused by the snap-action leaf spring control switch which, while supposedly in its off position, is nonetheless capable of fluttering rapidly between its on and off positions thereby switching the device timer motor and load rapidly on and off.

More specifically, the switch is of the kind that is referred to as being "normally closed." That is, the circuit is activated when the switch button is released to its closed position. As described above, when the ratchet follower has ridden high enough on the front face of a ratchet tooth, due to conjoint rotation of the star wheel and the-ratchet wheel, the switch is displaced inwardly to separate slightly the switch contacts whereupon the power to the timer motor and the load is disconnected. Because the timer mechanism operates slowly, stopping the timer motor stops the opening of the switch contacts with the switch left in this somewhat unstable condition with the contacts suspended in very close proximity to each other. In other words, slight separation of the switch contacts deactivates the timer motor before the switch snaps to its positive "off" or "open" state. This results in a situation wherein very little pressure is necessary to close the contacts and a small vibration can cause the contacts to touch to reactivate the timer mechanism. The cycle can thus become a rapid self-sustaining flutter since the switch has not yet snapped to tis positive open state.

It is therefore an object of this invention to ensure positive "off" switching to prevent damaging flutter in the control device.

SUMMARY OF THE INVENTION

The present invention is an improved control device for the star wheel/ratchet wheel type of mechanism described above which uses a "normally open" switch in place of the "normally closed" switch usually employed in devices of this kind. This is achieved by a unique ratchet wheel which is formed having a plurality of teeth, each having a front and a back face defining a tooth apex therebetween. A ratchet follower step is formed on the front face of each tooth. Between adjacent teeth is a well which is defined by the back face of a tooth and the front face of the next adjacent tooth.

Unlike the prior art, the present arrangement is such that the normally open switch is moved to its closed state by the displacement of the ratchet follower into engagement with the step on one of the ratchet wheel teeth. The switch is moved to its normally open position when the ratchet follower is disposed in one of the wells between adjacent teeth.

The operation of the device is generally the same as the prior art devices in that a stepping pawl separates the ratchet wheel from the star wheel, and a timer drives the star wheel to rotate the ratchet wheel after a predetermined time. More specifically, the ratchet wheel is disposed at the end of each stepping operation to move the ratchet follower into engagement with one of the steps to move the switch to its closed state. The ratchet follower is displaced out of engagement with the step on a front face of the tooth, upon conjoint rotation of the star wheel and the ratchet wheel; whereby it rides up the front face of the tooth and over the apex thereof and then drops down the back face of the tooth whereupon it is received with the next adjacent well to open the switch. This arrangement provides a positive off position of the switch which eliminates the fluttering problem heretofore referred to when the switch contacts were only spaced slightly apart.

For a better understanding of the invention, reference is made to the following detailed description of a preferred embodiment of the invention and the accompanying drawings.

DESCRIPTION OF THE PREFERRED EMBODIMENT

Figure 1:
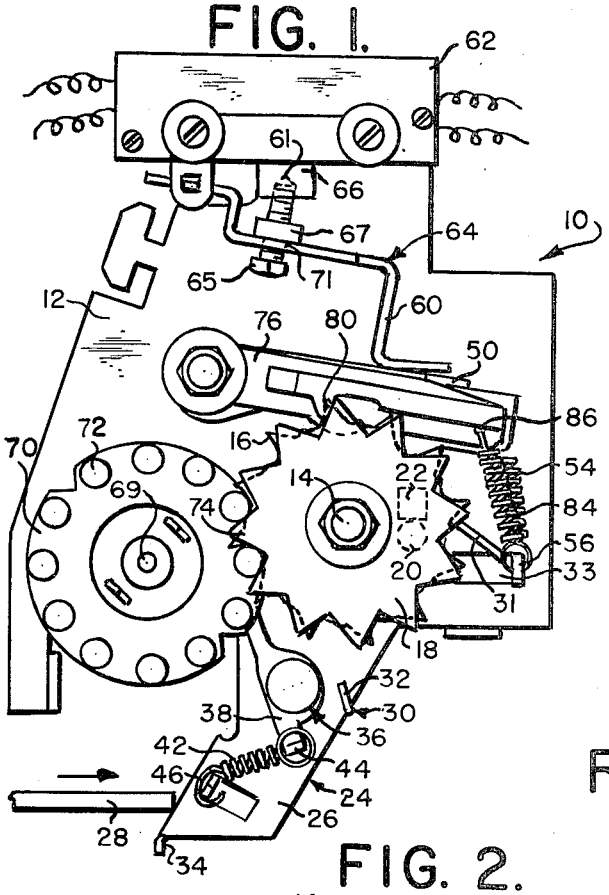
FIG. 1 is a front elevational view of the control device constructed in accordance with the present invention, and showing the switch displaced to its open state.

Referring to the drawings, numeral 10 represents a control device for a coin operated mechanism constructed in accordance with the present invention. In this regard, it will be assumed that the coin operated mechanism is of the type commonly referred to as a commercial appliance, such as, a clothes washer. In operation, upon the insertion of a coin in the control device, the mechanism will operate through a conventional cycle. Additional coins accumulate more time as is described in detail below.

Control device 10 is illustrated as including a mounting plate 12 having a fixed shaft 14 projecting outwardly therefrom. Rotatably mounted on shaft 14, in axially spaced relation, is a ratchet wheel 16 and a star wheel 18. A pin 20 projects outwardly from the front surface of ratchet wheel 16 and another similar pin 22 projects rearwardly from the back surface of star wheel 18. Pins 20, 22 project toward one another and are located at equal radial distances from the axis of the shaft. The arrangement is such that pins 20, 22 are adapted to engage with one another at the end of the operating cycle of the mechanism in the manner hereinafter described.

Figure 2:
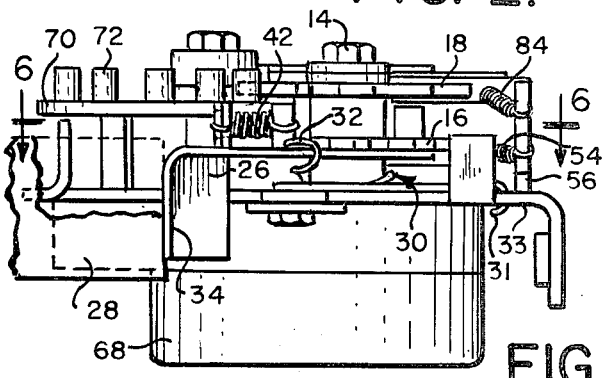
FIG. 2 is a bottom plan view thereof.

Stepping means, represented generally by numeral 24, is provided for rotating ratchet wheel 16, in a step-like manner, in a clockwise direction as viewed in FIG. 1. Stepping means 24 is illustrated as including an arm 26 oscillatably mounted on shaft 14 and operatively associated to the coin operated mechanism. In this regard, arm 26 is disposed for movement in a counterclockwise direction, as viewed in FIG. 1, upon projected movement of a coin slide 28 to its operate position. Projected movement of coin slide 28 is in a direction represented by the arrow in FIG. 1. Arm 26 is spring biased for movement in a clockwise direction by a coil spring 30 having one end 32 hooked over and engaged with arm 26 (FIG. 1) and being coiled around shaft 14. The other end 31 of spring 30 is anchored in a suitable opening 33 formed through plate 12. Arm 26 is also formed having a bent leg portion 34 disposed in the path of movement of coin slide 28 as illustrated more clearly in FIG. 2.

Stepping means 24 further comprises a pawl assembly, represented generally by numeral 36, which is illustrated as including a pawl 38 pivotally mounted on arm 26 by means of pivot pin 40. Pawl 38 is spring biased in a clockwise direction, as viewed in FIG. 1, by a spring 42 having one end connected to a post 44 on pawl 38 and the opposite end connected to a post 46 on arm 26. The arrangement is such as to locate the distant end of pawl 38 in engagement with the back face 47 of the teeth 48 of ratchet wheel 16. The back face 47 is normally steep or concave and is the surface over which a ratchet follower drops last as the ratchet wheel 16 rotates in its normal direction. It is the steep slope of back face 47 that stops ratchet follower 52 from riding in reverse up the tooth, thereby blocking counterrotation of the ratchet, to give normal ratchet action to the ratchet device. The front face 49 of the tooth is as usual, formed with a more gradual slope to permit ratchet follower 52 to ride out of the well 53 defined between adjacent ratchet teeth 48 (FIG. 6.)

Figure 3:
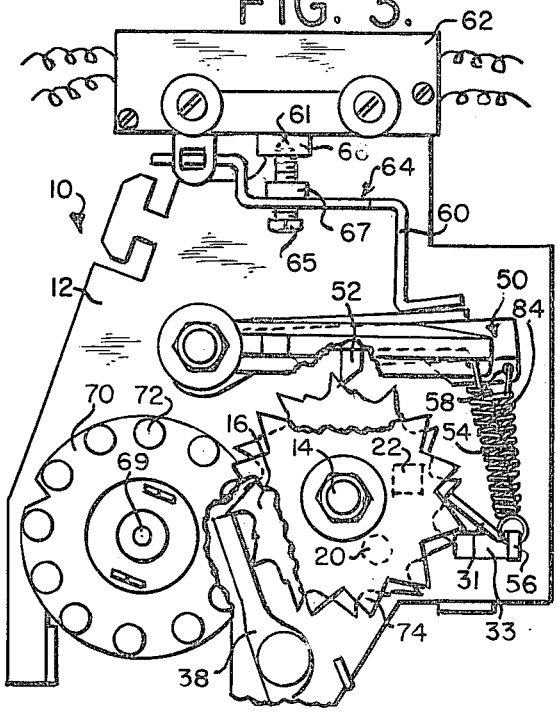
FIG. 3 is a view similar to FIG. 1, with parts broken away, showing the switch in its closed state.
Figure 4:
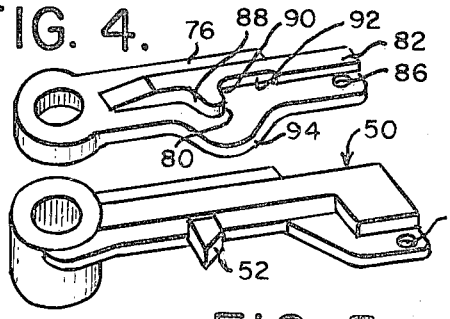
FIG. 4 is an exploded perspective view of the switch operating arm and the star wheel restraining lever.

Formed partway up front face 49 is a ratchet follower step 55 which ratchet follower 52 engages as it rides along front face 49. With reference to FIG. 3, an important relationship for proper operation of the present invention is that arm 50 is so disposed with respect to ratchet wheel 16 and stepping means 24 that ratchet follower 52 will be disposed in or engage with ratchet follower step 55 at the end of a full stepping cycle by stepping means 24. As will be brought out in detail below, this will cause switch 62 to be moved to its "closed" or "on" position.

Figure 6:
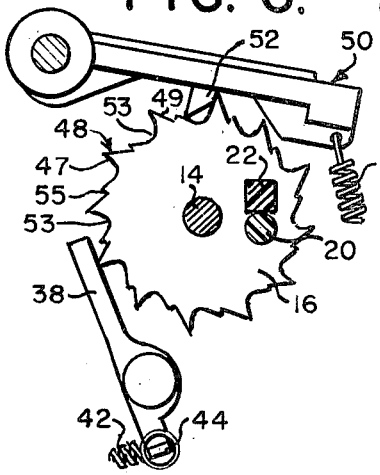
FIG. 6 is a sectional view taken along line 6—6 of FIG. 2.

The end of ratchet follower 52 is preferably beveled to a point as shown especially in FIG. 6 to match the shape of step 55, thereby to ensure close engagement with step 55. This restrains slippage between ratchet follower 52 and step 55 when they are interengaged.

It will now be appreciated that upon projected movement of coin slide 28 to is operate position, arm 26 is rotated in a counterclockwise direction which causes the tooth engaging end of pawl 38 to ride on the surface or face of a ratchet wheel tooth 48. This effects a camming action of pawl 38 as it pivots about pin 40 against the force of spring 42. This action continues until the tooth engaging end of pawl 38 is positioned behind the next adjacent tooth 48 of the ratchet wheel 16. Then, upon retracted movement of coin slide 28, the arm 26 rotates in a clockwise direction, under influence of spring 30, and returns to its original position. Such rotation of arm 26 causes the pawl 38 to engage the back face 47 of ratchet wheel tooth 48 in a manner to effect clockwise rotation of ratchet wheel 16, in step-like manner, a distance of one tooth.

Rotation of ratchet wheel 16 establishes an angular separation between ratchet wheel pin 20 and star wheel pin 22, as illustrated in FIG. 3. The extent of such separation will depend on the number of times that coin slide 28 is reciprocally operated. This, in turn, is dependent on the number of coins sequentially inserted in the slide to operate the mechanism. In this way, additional coins accumulate operating time. In other words, the angular distance through which ratchet wheel 16 is advanced is translated into the operating cycle duration of the mechanism, as hereinafter described.

It will be further appreciated that stepping means 24 can be operatively connected to a solenoid assembly or rotary device rather than a coin slide assembly to effect step-like rotation of ratchet wheel 16. An example of the use of a solenoid assembly to effect such rotation is disclosed in U.S. Pat. No. 3,172,520. Accordingly, the use of a coin slide assembly to effect operation of the stepping means herein is merely for purposes of describing a complete operation of the control device, and is not to be deemed a limitation on the invention.

As briefly discussed above, arm 50 is pivotally mounted on plate 12 and is formed with ratchet follower portion 52 engagable with the teeth 48 of ratchet wheel 16. Arm 50 is spring biased for movement in a clockwise direction, as viewed in FIG. 1, by a spring 54 having one end connected to arm 50 and the opposite end connected to a post 56 on plate 12. The connection of spring 54 to arm 50 is effected by means of a suitable opening 58 formed in the distant end portion of the arm 50 which accommodates or receives the said one end of the spring 54. The arrangement is such that follower portion 52 rides over the teeth 48 of ratchet wheel 16 under the influence of spring 54.

Mounted on the plate 12 and spaced from arm 50 is a normally open switch 62 having a pivotally mounted armature 64 with a leg portion 60 extending downwardly into engagement with arm 50. Switch 62 is provided with an operating button 66 which is normally biased outwardly by the switch mechanism (not shown). The button 66 is adapted to be depressed against the force exerted by the switch mechanism to change the state of the switch 62. In other words, if the switch 62 is wired to be normally open when the button 66 is outwardly disposed, then the switch 62 will be moved to a closed state when the button 62 is depressed. Switch 62 is adapted to be connected in circuit to initiate the operating cycle of the mechanism when the switch button 66 is depressed to render the switch in its closed state.

Figure 5:
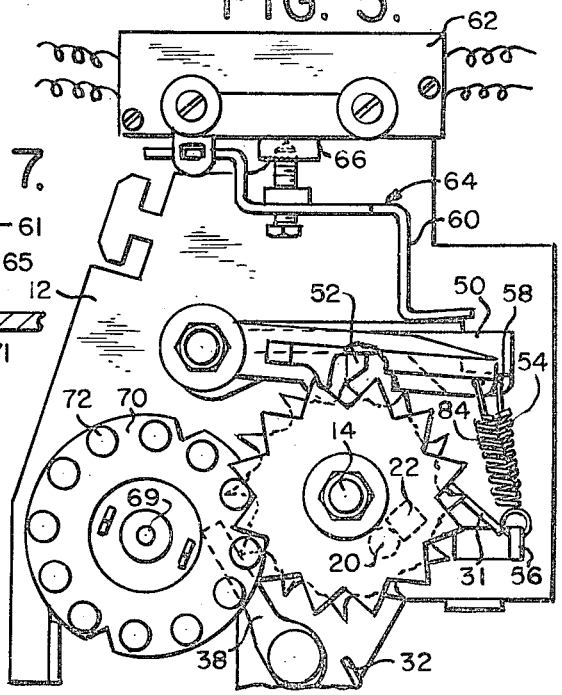
FIG. 5 is a view similar to FIG. 3 showing the star wheel and ratchet wheel operatively connected for conjoint rotational movement just prior to the displacement of the switch to its open state.
Figure 7:
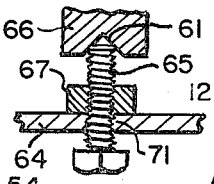
FIG. 7 is a sectional view showing the engagement of the switch activating armature pin with the switch button socket.

Referring generally to FIGS. 1, 3, 5 and especially to FIG. 7, engagement between armature 64 and button 66 is through engagement pin 65, preferably threaded and provided with a lock nut 67. This is received in a tapped hole 71 in the armature 64. As is readily realized, this arrangement permits fine control or adjustment of the timing of the switch 62 operation. Fine timing control is further enhanced by providing the end of pin 65 with a cone shape, and button 66 with a socket 61 shaped to receive and engage or capture the end of pin 65. This prevents sideways slippage of the button 66 when acted upon by pin 65, to give precise switching action. The significance of this control becomes more evident when one realizes that, in usual mechanisms a five thousandths of an inch slippage can affect the operating cycle of the mechanism by 5 to 10 minutes.

Referring to FIG. 3, it is to be noted that when switch 62 is in its closed state, the follower portion 52 of switch operating arm 50 is located in ratchet follower step 55 formed in the front face 49 of ratchet teeth 48. In order to effect movement of switch 62 to its open state, switch operating arm 50 must be rotated in a clockwise direction to effect similar clockwise rotation of armature 64, and permit button 66 to project out of switch 62. Such movement of button 66 effects movement of switch 62 to its normally open state to terminate the operating cycle of the mechanism.

The length or duration of the operating cycle is controlled by an electrically operated timer mechanism 68 mounted on plate 12. The timer mechanism 68 has an energizing circuit that is controlled by switch 62. In other words, movement of switch 62 to its closed state also serves to energize timer mechanism 68. The timer mechanism 68 has a motor which turns at a uniform rate of speed and is provided with an output shaft 69. Fixedly connected to the timing motor output shaft 69 is a pin wheel 70 having a specific number of pins 72 spaced equidistant along its periphery. The number and location of pins 72 is selected in accordance with the desired time of operation of the coin operated mechanism for each coin insertion into slide 28.

The arrangement is such that as pin wheel 70 rotates in a counterclockwise direction, the pins 72 engage with the teeth 74 of star wheel 18 to rotate, intermittently, said star wheel in the same clockwise direction of rotation as ratchet wheel 16. In other words, each time a pin 72 engages a tooth of star wheel 18, the wheel is advanced one tooth in a clockwise direction. Pin wheel 70 thus represents stepping means operable when switch 62 is in its closed state for rotating star wheel 18. When the number of such periodic advances equal the total advance of ratchet wheel 16 by stepping means 24, then star wheel pin 22 engages with the ratchet wheel pin 20, as shown in FIG. 5. Thereafter, on the next engagement of a pin 72 with a star wheel tooth 74, star wheel 18 and ratchet wheel 16 are rotated conjointly in said clockwise direction due to the engagement of pins 20, 22. Such rotation of ratchet wheel 16 permits ratchet wheel follower 52 to ride up front face 49 and out of the ratchet follower step 55 to continue up and over ratchet tooth apex 57 where it drops over front face 49 and into the next adjacent well 53. This allows switch operating arm 50 to drop or rotate in a clockwise direction freeing switch 62 to snap to its normally open position, turning off the coin operating mechanism and simultaneously de-energizing the timer 68.

Engagement of pin wheel 70 with the teeth 74 of star wheel 18 restrains significant counterclockwise rotation of said star wheel 18 when switch 62 is in its open state. The restrain ing of such counterclockwise rotation of star wheel 18 is augmented by the action of a lever 76 which restrains even slight counterrotation of said star wheel.

Lever 76 is pivotally mounted on plate 12 having restraining means comprising finger portion 80 projecting outwardly from lever 76 and positioned in the path of rotation of star wheel 18 to engage one of the teeth 74 of star wheel 18 and prevent rotation of said wheel 18 in a counterclockwise direction when switch 62 is in its open state. Preferably, lever 76 has a front surface lying in a plane substantially perpendicular to the axis of the shaft 14, and the lever is formed having a raised portion 82 projecting outwardly from its front surface and extending longitudinally thereof.

Lever 76 is spring biased for movement in a clockwise direction by a spring 84 having one end connected to lever 76 and the opposite one connected to the post 56 on plate 12. The connection of spring 84 to lever 76 is effected by means of a suitable opening 86 formed in the distant end portion of the lever which accommodates or receives the said one end of the spring. The arrangement is such that lever 76 is disposed for movement from a rest position, as shown in FIG. 1, to a displaced position which permits the finger portion 80 to be moved to a position to restrain rotation in either direction.

Finger portion 80 is formed having a camming surface 88 and a shoulder abutment surface 90. In operation, rotation of star wheel 18 in a clockwise direction by means of the stepping pin wheel 70 causes one side of a star wheel tooth 74 to engage the camming surface 88 of finger portion 80 to effect rotation of lever 76 in a counterclockwise direction. Such rotation is tantamount to movement of lever 76 to a displaced position which permits finger portion 80 to ride over the apex of said star wheel tooth 74 whereupon lever 76 moves back to its rest position, as shown in FIG. 1, under influence of spring 84. Movement of lever 76 in the manner described serves to locate the shoulder abutment surface 90 of finger portion 80 in position relative to the opposite side of said star wheel tooth 74 to prevent rotation of said star wheel in a counterclockwise direction when switch 62 is in its open state. In this regard, even the slightest counterclockwise rotation of star wheel 18 serves to locate the opposite side of said star wheel tooth 74 in contact with the shoulder abutment surface 90 of finger portion 80.

To provide clearance for the star wheel teeth 74 and to permit unobstructed rotation of star wheel 18 in a clockwise direction, the projecting portion 82 of lever 76 is formed having a recessed surface 92. Lever 76 is further formed having a downwardly projecting portion 94 disposed to continuously overlie a segment of the back surface of star wheel 18 in all positions in the path of pivotal movement of lever 76 from its rest position to its displaced position. The overlying portion 94 serves to prevent lateral displacement of lever 76 in a direction away from plate 12. In other words, vertical alignment of lever 76 with star wheel 18 is maintained to assure that finger portion 80 properly engages with the teeth 74 of said wheel.

There is thus provided an improved control device for a coin operated mechanism having novel switch operating arrangement to ensure positive deactivation of the control device and of the operating cycle of the mechanism after the control device has completed a cycle of operation. While a preferred embodiment of the invention has been shown and described in detail, it will be readily understood and appreciated that numerous omissions, changes and additions may be made without departing from the spirit and scope of the present invention.

What I claim is:

1. In a control device for a coin operated mechanism wherein the device includes a ratchet wheel engaged with a ratchet follower, the ratchet wheel being disposed for rotation to displace the ratchet follower to open and close a switch and operate the mechanism, a stepping pawl operable to rotate the ratchet wheel and displace the ratchet follower to close the switch, and a star wheel operatively driven by a timing mechanism into engagement with the ratchet wheel when the switch is in its closed state to rotate the ratchet wheel and displace the ratchet follower to open the switch, wherein the improvement comprises:

(a) said ratchet wheel having a plurality of teeth each having a front and a back face defining a tooth apex therebetween, each said front face including a ratchet follower step, the back face of each tooth and the front face of the next adjacent tooth defining a well therebetween;

(b) said switch being a normally open type switch and being so disposed as to be moved to its closed state by the displacement of said ratchet follower into engagement with the step on one of said ratchet wheel teeth, and to move to its normally open state when said ratchet follower is disposed in one of said wells between adjacent teeth;

(c) said ratchet wheel being disposed, at the end of each stepping operation, to move said ratchet follower into engagement with one of said steps to move said switch to its closed state at the end of each stepping operation; and (d) said ratchet follower being displaced out of engagement with the step on a front face of one of said teeth, upon conjoint rotation of said star wheel and said ratchet wheel, to ride up said front face and over said apex and drop down the back face of said tooth wherein said follower is received within the next adjacent well thereby to open said switch.

2. A control device for a coin operated mechanism, said device comprising:

(a) a mounting plate;

(b) a shaft projecting from said mounting plate;

(c) a ratchet wheel and a star wheel rotably mounted on said shaft in axially spaced relation, each of said wheels having a pin thereon projecting toward the other wheel, and said pins each being located at an equal radial distance from the axis of said shaft;

(d) said ratchet wheel having a plurality of teeth each having a front and a back face defining a tooth apex therebetween, each said front face including a ratchet follower step, the back face of each tooth and the front face of the next adjacent tooth defining a well therebetween;

(e) first stepping means oscillatably mounted on said shaft and operatively connected to the coin operated mechanism, said stepping means comprising a pawl assembly engagable with the teeth of said ratchet wheel to step-wise rotate said wheel in one direction by a distance of one tooth, upon movement of said stepping means;

(f) switch means mounted on said plate having a switch movable from a normally open state to a closed state;

(g) a spring biased switch operating arm pivotally mounted on said plate and operatively connected to said switch, said arm having a follower portion engagable with the teeth of said ratchet wheel and movable between a first position wherein said follower is received within one of said wells, and a second position wherein said follower is engaged with one of said steps;

(h) said switch being in its open state when the follower portion of said switch operating arm is located in its first position and said switch being moved to its closed state when said follower portion is located in its second position;

(i) said first stepping means rotating said ratchet wheel to be disposed, at the end of each stepping operation, to move said follower portion to its second position thereby to move said switch to its closed state at the end of each stepping operation;

(j) an electrically operated timer mounted on said plate having an energizing circuit controlled by said switch, said timer comprising second stepping means operable when said switch is in its closed state to engage with the teeth of said star wheel and intermittently rotate said star wheel in the same direction of rotation of said ratchet wheel, such rotation of said star wheel causing the pin thereof to engage with the pin of said ratchet wheel, further rotation of said star wheel causing said ratchet wheel to rotate conjointly therewith; and (k) the follower portion of said switch operating arm being displaced from its second position, wherein said follower portion is in engagement with the step on a front face of one of said teeth, to ride up said front face and over said apex and drop down said back face of said tooth to its first position, wherein said follower portion is received within the next adjacent well, upon conjoint rotation of said star wheel and said ratchet wheel, thereby to open said switch.

3. The control device of claim 2 wherein:

(a) said spring biased switch operating arm further comprises a switch engagement pin having an outwardly extending end, and (b) said switch including an activating button and being movable between states by the protraction and retraction of said button, said button having formed therein a socket operable to receive said outwardly extending pin end for non-slip engagement therebetween.

4. The control device of claim 3 wherein said outwardly extending pin end is substantially cone-shaped and said button socket is substantially cone shaped.

5. The control device of claim 3 or 4 wherein said engagement pin comprises a threaded rod and said switch operating arm includes a tapped hole adjustably receiving said threaded rod.

6. The control device of claim 5 further comprising a lock nut received over said threaded rod to lock it in place in said tapped hole.

* * * * *